US006015127A

United States Patent [19]

Carr

[11] Patent Number: 6,015,127

[45] Date of Patent: Jan. 18, 2000

[54] APPARATUS FOR SUSPENDING AND STORING ARTICLES

[76] Inventor: Jackson M. Carr, 1730 Jefferson St., Napa, Calif. 94559

[21] Appl. No.: 09/057,388

[22] Filed: Apr. 8, 1998

[51] Int. Cl.[7] ..... A47F 5/08; B42F 13/00

[52] U.S. Cl. ..... 248/339; 248/113

[58] Field of Search ..... 248/339, 340, 248/341, 215, 307, 211, 290.9, 294.1, 308; 211/113, 117; D8/367, 356, 373, 383

[56] References Cited

U.S. PATENT DOCUMENTS

| | | | |
|---|---|---|---|
| 3,323,770 | 6/1967 | Wolar | 248/339 |
| 3,592,343 | 7/1971 | Swett | 211/113 |
| 3,692,269 | 9/1972 | Einhorn et al. | 248/339 |
| 5,507,460 | 4/1996 | Schneider | 248/339 |

*Primary Examiner*—Derek J. Berger
*Assistant Examiner*—Michael Nornberg
*Attorney, Agent, or Firm*—Larry D. Johnson

[57] ABSTRACT

A belay and rope apparatus for suspending and storing various articles such as bicycles and sports equipment includes a belay member which has a vertical axis and includes a top portion having a first rope aperture and a second rope aperture, a medial portion connected to the top portion defining a first hook-shaped element having an arcuate base with a third rope aperture, and a bottom portion connected to the medial portion defining an arcuate cleat element with a fourth rope aperture, each of the rope apertures preferably disposed along the vertical axis. The user may insert ropes through or around the apertures in the belay member(s) to suspend the members from an overhead support such as a rafter or ceiling joist, so that he may then suspend a bicycle or other article(s) in the hook portion of the belay.

6 Claims, 3 Drawing Sheets

APPARATUS FOR SUSPENDING AND STORING ARTICLES

BACKGROUND OF THE INVENTION

1. Field of the Invention

This invention relates generally to hooks, fasteners, and other hardware, and more specifically to an improved belay or hook apparatus for suspending and storing various articles such as bicycles and sports equipment.

2. Description of the Prior Art

Numerous hooks, fasteners, and related devices have been developed to permit a user to suspend and store articles. For example, the common "J" hook is routinely used to store bicycles by securing a pair of the hooks into an overhead beam, and placing the bicycle wheels or frame into the hooks. However, use of such "J" hooks (or their equivalent) can be problematic. For example, once installed, the "J" hook becomes a permanent fixture, therefore preventing moveability. In addition, the "J" hooks must be directly secured to a beam or other fixed member, limiting the possible orientations of the articles to be suspended. Still further, the "J" hooks do not allow the user to vertically stack or hang multiple items.

SUMMARY OF THE INVENTION

The apparatus for suspending and storing articles of this invention provides an improved belay or hook and rope apparatus for suspending and storing various articles such as bicycles and sports equipment. The inventive belay member has a vertical axis and includes a top portion defining a generally triangle-shaped point element having a first rope aperture disposed proximate the center of the point element, and a second rope aperture disposed proximate the base of the point element, a medial portion connected to the top portion defining a first hook-shaped element having an arcuate base with a third rope aperture, and a bottom portion connected to the medial portion defining an arcuate cleat element with a fourth rope aperture, each of the rope apertures preferably disposed along the vertical axis.

The user may insert ropes through or around the apertures in the belay members to suspend the members from an overhead support such as a rafter or ceiling joist, so that he may then suspend a bicycle or other article(s) in the hook portion of the belay. The arrangement is superior to traditional J-hooks, in that the inventive belays can be suspended by their ropes at any point along the length of a joist, and swung into a desired position, enabling the user to suspend a bicycle or other article parallel with, perpendicular to, or at any angle to the joists themselves (e.g., the sixteen inch center to center spacing of most joists does not match the wheel to wheel dimension of most bikes, so traditional J-hooks can only be used to support a bike parallel to the joists). In addition, the apertures in the medial and bottom portions of the belay member enable further connection of ropes, so that large bulky items (such as a canoe or kayak) can be encircled by and supported by a sling or noose formed from these ropes. In addition, a series of the belay members can be suspended at different heights along a length of rope, enabling the user to suspend two or more bicycles or other articles atop one another in a vertical array. In this circumstance, the user would likely raise and lower the series of belays by the rope passing over the overhead support (e.g., ceiling joist).

The apparatus for suspending and storing articles or this invention thus provides numerous advantages, including but not limited to the following. The inventive apparatus allows multiple hanging configuration and allows the user to store multiple items. Items can be stored and hung vertically. The apparatus is easy to install and no tools are required, thus making it moveable and not a permanent fixture. The apparatus allows the user to span a greater distance than other products by utilizing the adjustable rope, solving the problem with its flexibility. The inventive apparatus allows the user to hang bicycles, sports equipment, windsurfers, snowboards, surfboards, kayaks, canoes, golf clubs or other paraphernalia such as tools, ladders, garden equipment, etc.

DETAILED DESCRIPTION OF A PREFERRED EMBODIMENT

Figure 1:
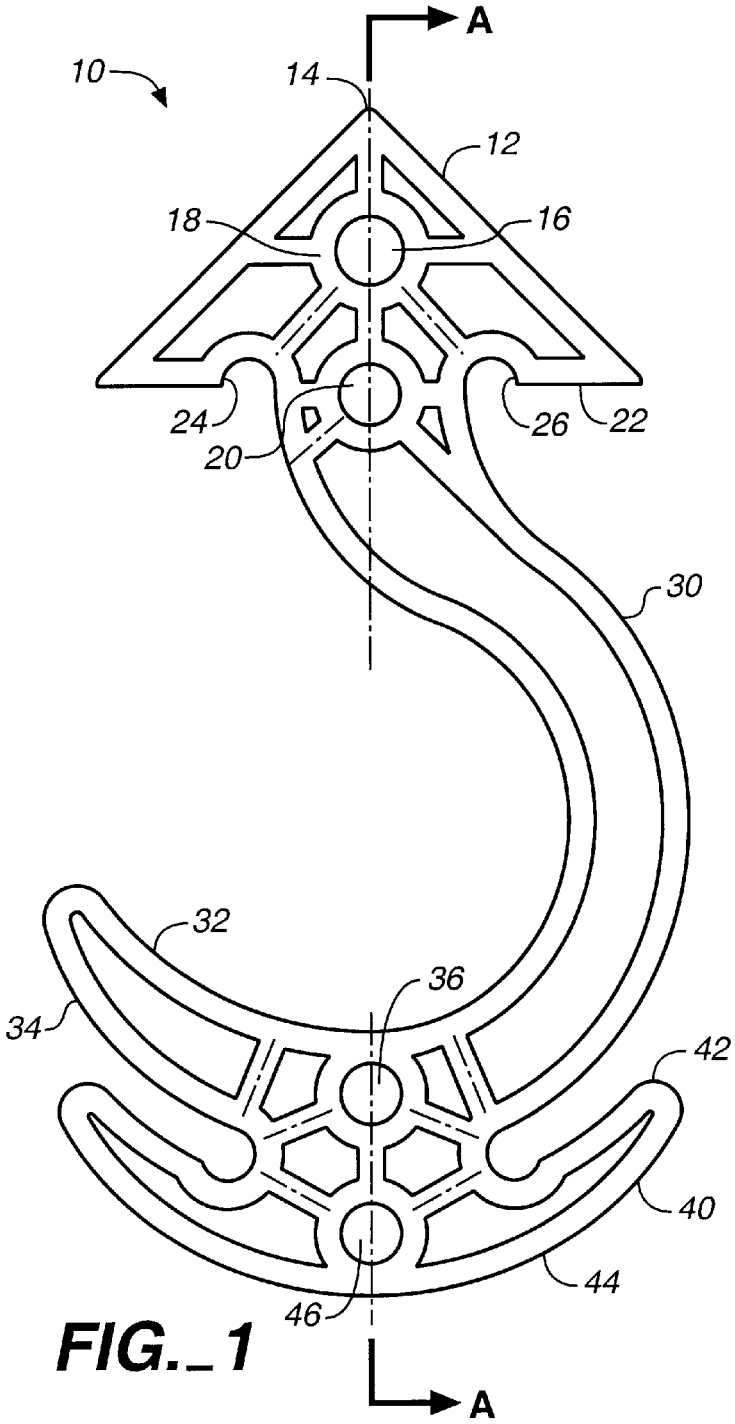
FIG. 1 is a front elevation view of a belay or hook member of the apparatus for suspending and storing articles of this invention.

FIG. 1 is a front elevation view of a belay or hook member 10 of the apparatus for suspending and storing articles of this invention. Belay member 10 has a vertical axis A and preferably includes a top portion 12 defining a generally triangle-shaped point element 14 having a first rope aperture 16 disposed proximate the center 18 of the triangle-shaped point element 14, and a second rope aperture 20 disposed below the first rope aperture 16 proximate the base 22 of the triangle-shaped point element 14. The base 22 of the triangle-shaped point element 14 may include a pair of detents 24, 26 disposed on opposite sides of second rope aperture 20 to aid in rope capture, as described infra.

Belay member 10 further includes a medial portion 30 connected to the top portion 12 proximate base 22 of the triangle-shaped point element 14, and defines a first hook-shaped element 32 having an arcuate base 34, with a third rope aperture 36 disposed in the arcuate base 34.

Belay member 10 further includes a bottom portion 40 connected to the medial portion 30 proximate arcuate base 34 of the hook-shaped element 32, and defines an arcuate cleat element 42 having an arcuate base 44, with a fourth rope aperture 46 disposed in the arcuate base 44.

Each of the rope apertures 16, 20, 36 and 46 is preferably disposed along vertical axis A. This alignment may improve the balance of the system, especially when a plurality of belay members are utilized in a vertical array.

The belay member may be made from any appropriate material such as injection-molded plastic (e.g., polycarbonate), or any other suitably strong, durable material. The dimensions of the belay member may of course vary with the particular application, but a size of approximately 8.375 inches in height, 4.5 inches wide (at the bottom portion), and 0.625 inches thick may be desirable.

Figure 2:
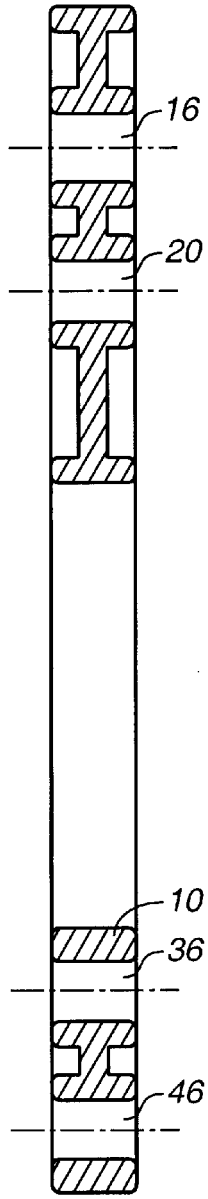
FIG. 2 is a side elevation cross-sectional view of the belay member of FIG. 1, this view taken along line A—A of FIG. 1.

FIG. 2 is a side elevation cross-sectional view of the belay member 10 of FIG. 1, this view taken along line A—A of FIG. 1. This view illustrates the preferred "beam" construction of the belay member, as well as the relative alignment of the rope apertures 16, 20, 36 and 46.

Figure 3:
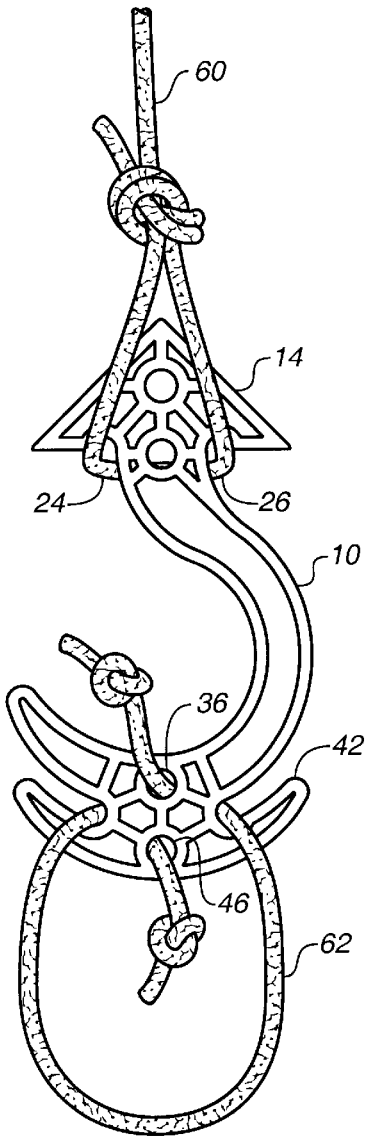
FIG. 3 is a front elevation view of a belay member of this invention as installed and suspended from an overhead support by a first rope segment, with a second rope segment secured to the medial and bottom portions of the belay member to form a rope sling.

FIG. 3 is a front elevation view of a single belay member 10 of this invention as installed and suspended from an overhead support (not visible in this view) by a first rope segment 60 (such as a segment of six millimeter climbing rope) encircling the triangle-shaped point element 14 and engaging the detents 24, 26 (and then knotted). A second rope segment 62 is secured to the medial and bottom portions of the belay member 10 to form a rope sling, by being passed through third rope aperture 36, over arcuate cleat element 42, and through fourth rope aperture 46 (and then knotted). The rope segment 60 is preferably placed over a sufficiently strong overhead support structure such as a beam, ceiling joist, or other substantial support. Alternatively, the rope segment may be attached to an eyebolt, hook, or other structural feature itself secured to the overhead support.

Figure 4:
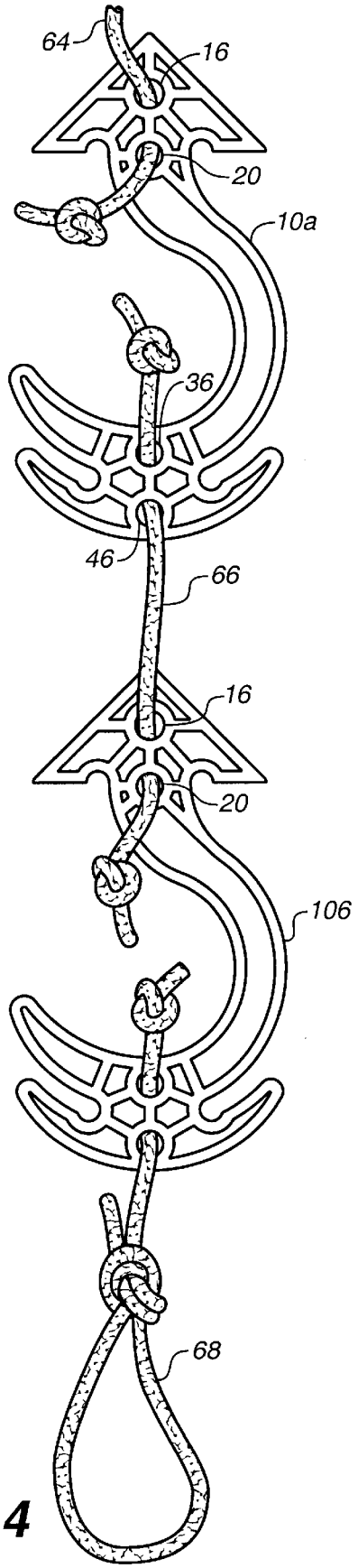
FIG. 4 is a front elevation view of a vertical pair of belay members of this invention as installed and suspended from an overhead support by first and second rope segments, with a third rope segment secured to the medial and bottom portions of the lower belay member to form a rope noose.

FIG. 4 is a front elevation view of a vertical pair of belay members 10*a*, 10*b* of this invention as installed and suspended from an overhead support by first and second rope segments 64, 66. First rope segment 64 suspends upper belay member 10*a* by being threaded through first rope aperture 16 and second rope aperture 20 (and then knotted). Second rope segment 66 suspends lower belay member 10*b* from upper belay member 10*a* by being threaded through rope apertures 36, 46 of upper belay member 10*a*, and rope apertures 16 and 20 of lower belay member 10*b*. Third rope segment 68 is secured to the medial and bottom portions of the lower belay member 10*b* to form a rope noose in like fashion.

Figure 5:
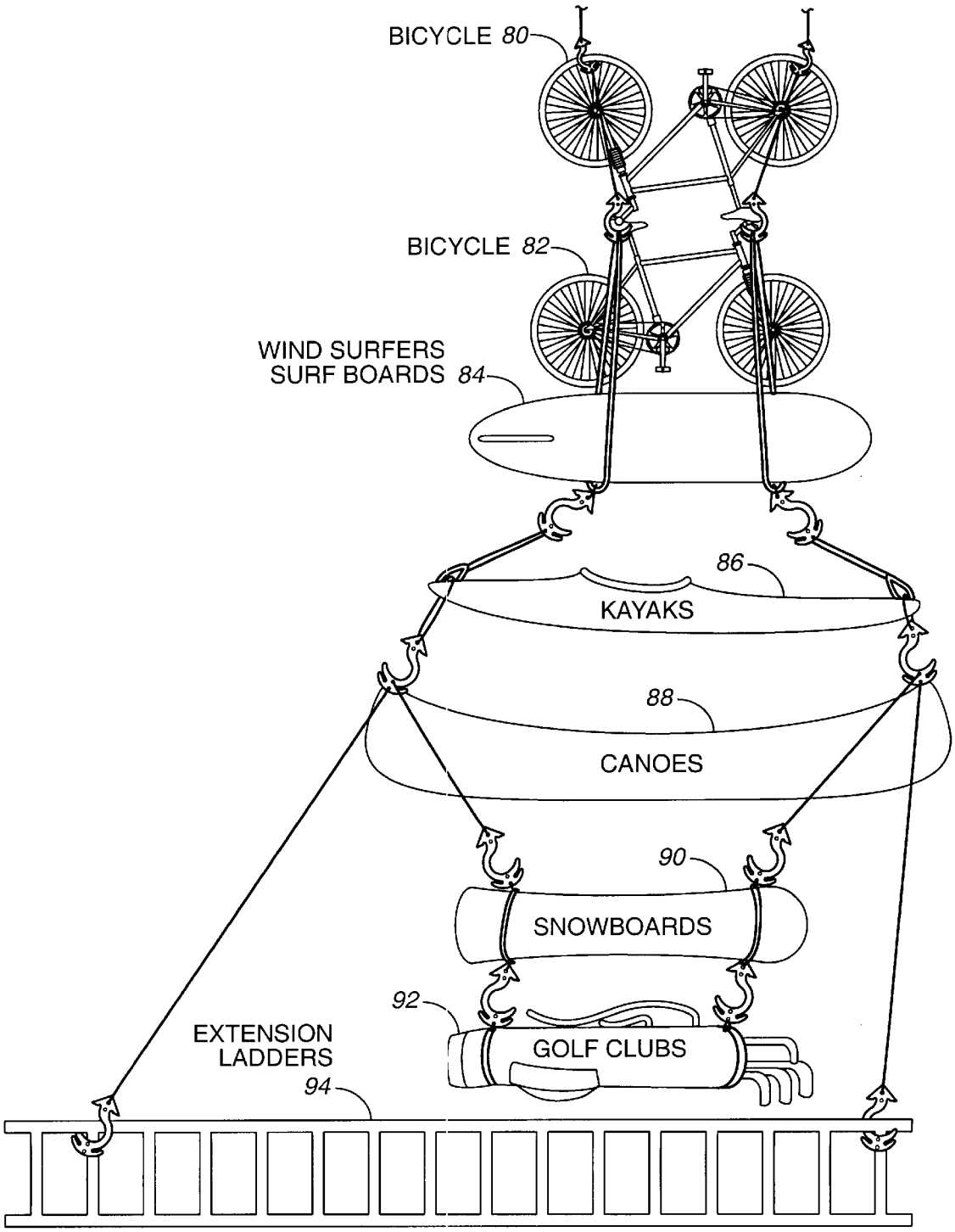
FIG. 5 is a front elevation view of a plurality of belay members of this invention being used to suspend and store an array of articles.

FIG. 5 is a front elevation view of a plurality of belay members 10 of this invention being used to suspend and store an array of articles, such as bicycles 80, 82, surfboard 84, kayak 86, canoe 88, snowboard 90, golf clubs 92, and extension ladder 94.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. An apparatus for suspending and storing articles from an overhead support, said apparatus comprising:

a belay member having a vertical axis, said belay member including a top portion having a center and a base, a first rope aperture disposed proximate said center of said top portion, and a second rope aperture disposed proximate said base of said top portion, said top portion defining a generally triangle-shaped point element including a base having a pair of detents disposed on opposite sides of said second rope aperture.;

a medial portion connected to said top portion, said medial portion defining a first hook-shaped element having an arcuate base and having a third rope aperture; and a bottom portion connected to said medial portion, said bottom portion defining an arcuate cleat element and a fourth rope aperture, each of said first, second third and fourth rope apertures disposed along said vertical axis.

2. The apparatus for suspending and storing articles of claim 1 wherein said medial portion third rope aperture is disposed in said arcuate base.

3. The apparatus for suspending and storing articles of claim 1 wherein said bottom portion arcuate cleat element includes an arcuate base.

4. The apparatus for suspending and storing articles of claim 3 wherein said fourth rope aperture is disposed in said arcuate base.

5. The apparatus for suspending and storing articles of claim 1 wherein said belay member is made from plastic.

6. The apparatus for suspending and storing articles of claim 1 including at least one rope segment for releasable attachment to at least one of said first, second, third and fourth rope apertures.

* * * * *